United States Patent [19]

Brandeau et al.

[11] 4,086,697

[45] May 2, 1978

[54] APPARATUS FOR MAKING WIRE TERMINATION ASSEMBLIES

[75] Inventors: Edward P. Brandeau, Willimantic, Conn.; John M. Gentry, Asheville, N.C.

[73] Assignee: Akzona Incorporated, Asheville, N.C.

[21] Appl. No.: 808,064

[22] Filed: Jun. 20, 1977

[51] Int. Cl.[2] ..... H01R 43/04

[52] U.S. Cl. ..... 29/749; 29/753

[58] Field of Search ..... 29/749, 751, 753, 758, 29/759

[56] References Cited

U.S. PATENT DOCUMENTS

| | | | |
|---|---|---|---|
| 3,866,293 | 2/1975 | Nijman | 29/749 X |
| 4,043,017 | 8/1977 | Folk et al. | 29/749 |

*Primary Examiner*—Carl E. Hall

*Attorney, Agent, or Firm*—Leydig, Voit, Osann, Mayer & Holt, Ltd.

[57] ABSTRACT

An apparatus for applying progressive force to a wire positioned in a plate slot in which the plate is positively positioned against stops on a reciprocating carrier and the force is applied by arcuate feet on a journalled roller, the roller and the carrier being mounted on a rigid frame and coupled to maintain a predetermined angular position of the roller for every linear position of the carrier, thus assuring proper relative movement when the roller is turned by a crank.

4 Claims, 7 Drawing Figures

Fig. 3.
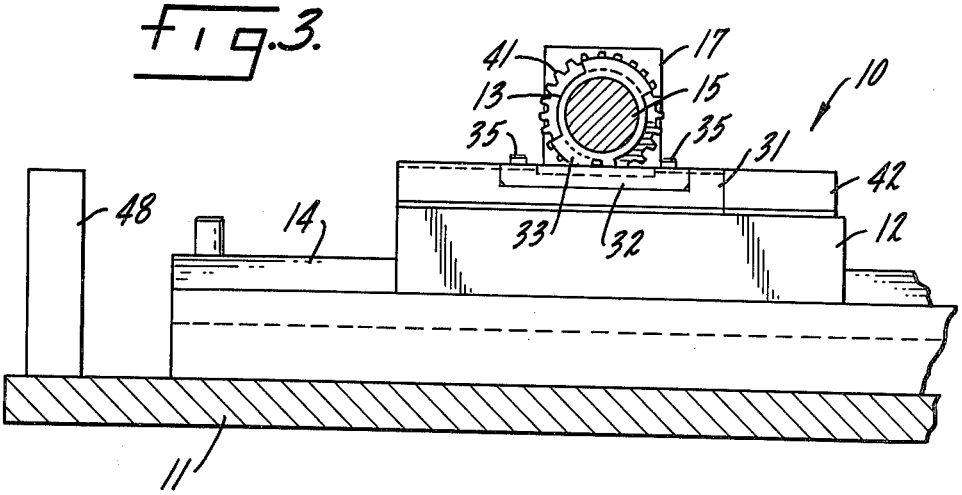
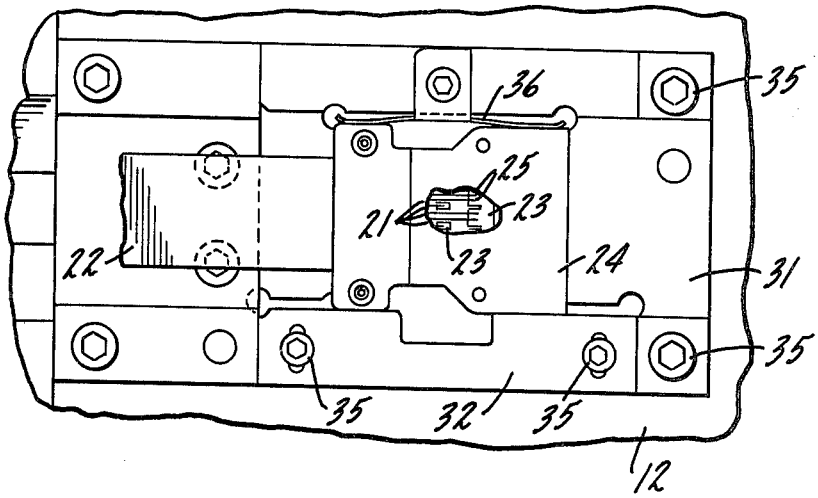
Fig. 6.
Fig. 7.
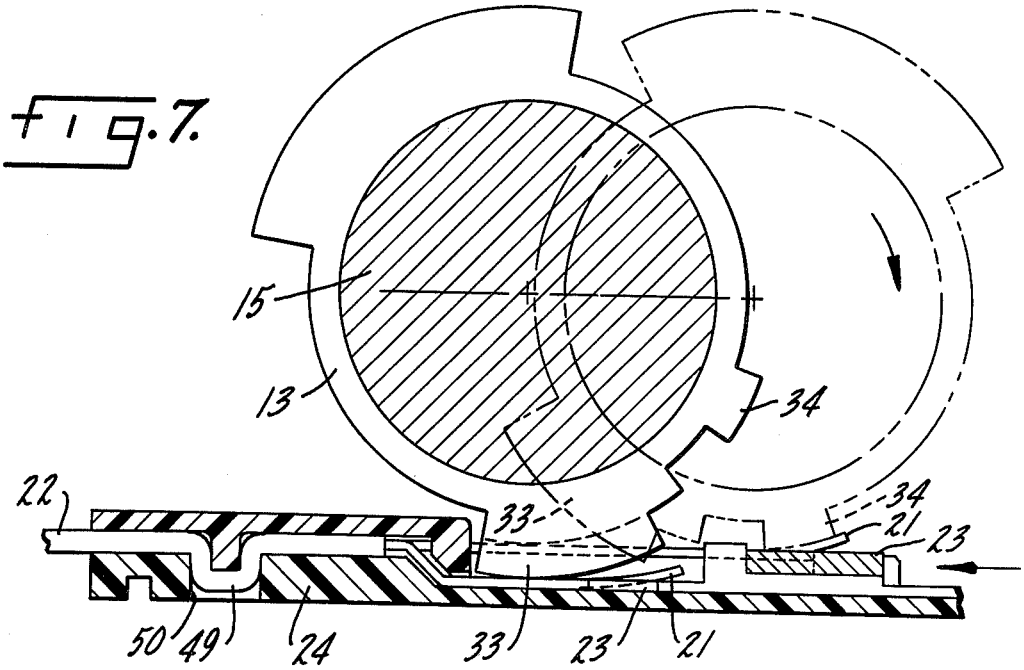

APPARATUS FOR MAKING WIRE TERMINATION ASSEMBLIES

The present invention relates generally to apparatus for making electrical wire termination connections, and more particularly concerns a hand tool for mechanically securing a plurality of fine wires to a connector.

Signal carrying cable for such applications as telephone switching units and computer hardware jumpers are typically formed as triplets, a signal carrying wire being flanked by a pair of ground wires to insure signal isolation. Since small amounts of power are involved, such wire is typically quite fine and often multiple signal wires, each with shielding ground wires, are formed in one cable. One version of such cable provides, in a flat cable only about ¾ of an inch wide and 1/32 of an inch thick, eight signal wires each flanked by a pair of ground wires for a total of 24 wires spaced on approximate 1/32 inch centers.

Connectors for such multiple strand cable must, basically, electrically terminate the signal and ground wires, and provide a transition to connector sockets on 1/10 or ⅛ inch centers which are typical pin spacings on circuit boards. A connector-cable assembly of this kind is disclosed in copending application Ser. No. 771,109, filed Feb. 23, 1977 and assigned to the assignee of the present application. In that assembly, a form of crimped electrical connection is utilized requiring mechanical force applied in a particular manner to the multiple wires of the cable. Because a large number of closely spaced wires are involved, and because the wires are small in diameter and hence subject to damage while being difficult to handle, there are practical problems in making that assembly. And obviously, the practical success of that particular cable-connector assembly is at least partially dependent on being able to accomplish that assembly.

Accordingly, it is the primary aim of this invention to provide apparatus for reliably making the termination assembly described in the above identified application. A related object of the invention is to provide an apparatus of the foregoing character that has the rigidity, preciseness and simplicity to accurately perform its intended function without elaborate set-up or adjustment effort.

Another object is to provide a tool as discussed above that is easy to use, even for those without special skills or training.

A further object is to provide a tool as characterized above that is compact and sturdy, and otherwise well suited for job site operation so that cable can be cut to length for a given application and quickly assembled with a terminating connector.

Other objects and advantages of the invention will become apparent upon reading the following detailed description and upon reference to the drawings, in which:

FIG. 3 is a fragmentary section taken approximately along the line 3—3 in FIG. 2;

FIG. 6 is a fragmentary plan, enlarged, of a portion of the apparatus shown in FIG. 1; and FIG. 7 is an enlarged fragmentary somewhat diagrammatic section showing the operation of the apparatus of FIG. 1.

Figures 1, 2, 4, 5:
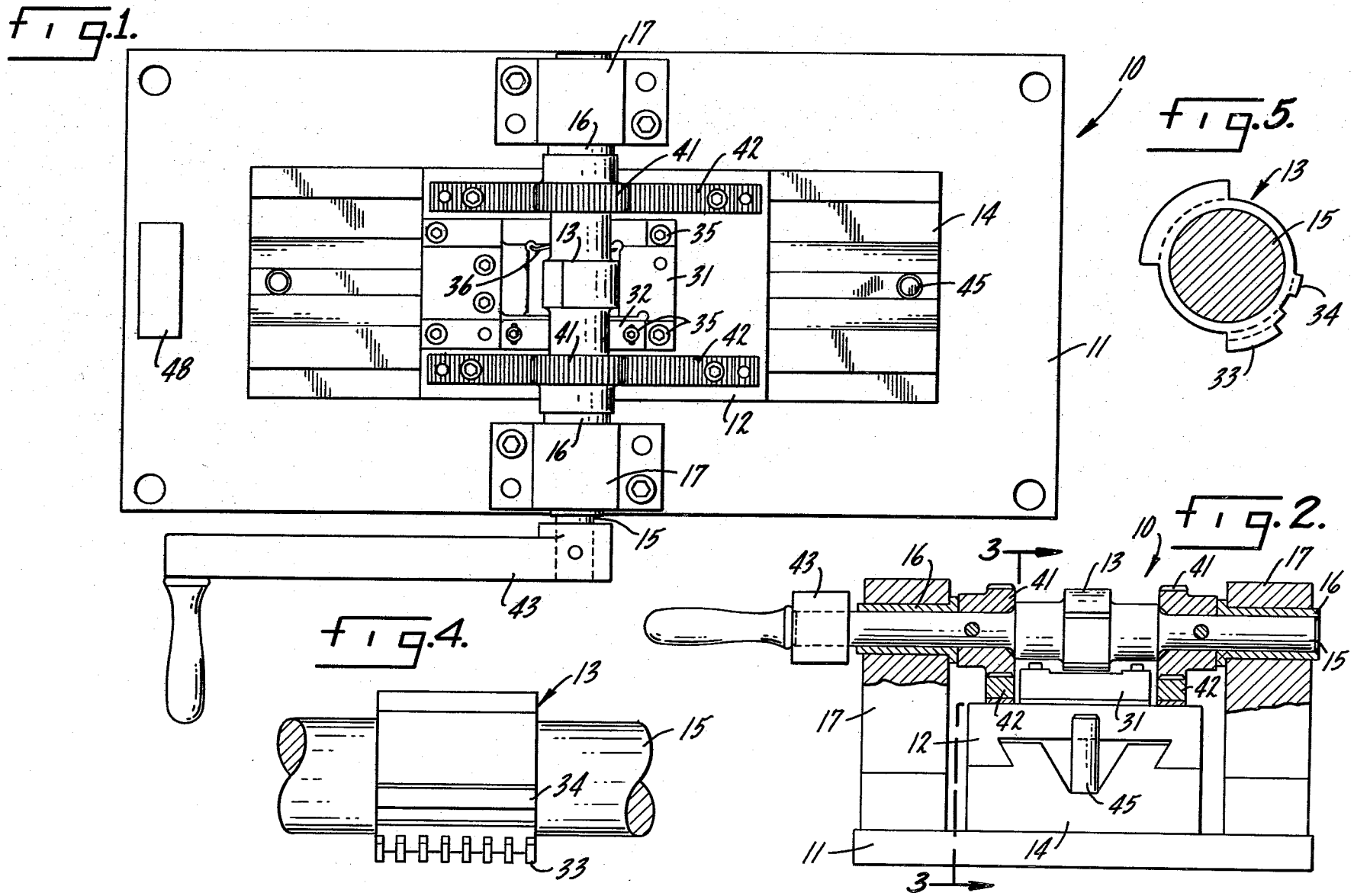
FIG. 1 is a plan view of an apparatus embodying the invention.
FIG. 2 is an end elevation partially in section of the apparatus shown in FIG. 1.
FIG. 4 is an enlarged fragmentary end elevation of the force applying portion of the apparatus shown in FIG. 1.
FIG. 5 is a side elevation of that portion of the structure shown in FIG. 4.

While the invention will be described in connection with a preferred embodiment, it will be understood that we do not intend to limit the invention to that embodiment. On the contrary, we intend to cover all alternatives, modifications and equivalents as may be included within the spirit and scope of the invention as defined by the appended claims.

Turning to the drawings, there is shown an apparatus 10 embodying the invention and including a base frame 11, a carrier 12 mounted on the frame 11 for linear reciprocation, and a roller 13 journalled on the frame 11 above the carrier 12. Preferably, the carrier 12 is mounted on a way bed 14 fixed on the frame 11 so that the carrier is constrained for true linear movement and sturdily supported against downward forces. The roller 13 is mounted on a shaft 15 journalled in sleeve bearings 16 fitted in frame posts 17 so as to closely and solidly hold the roller axis relative to the frame 11.

The apparatus is intended to mechanically connect the wires 21 of a cable 22 to transition plates 23 in a connector 24 by having the wires 21 overlie open throated slots 25 in the plates 23 and applying force progressively from the open throat toward the slot so as to wedge-guide the wire ends over the slots and then force the wires into the slots. The cable, connector and method of termination is disclosed in more detail in said prior application Ser. No. 771,109.

In accordance with the present invention, the cable-connector assembly is positively positioned against stop portions 31 and 32 on the carrier 12, radially projecting feet 33 and 34 and arcuate outer surfaces are formed on the roller 13, and the roller and carrier 12 are coupled to maintain a predetermined angular position of the roller for every linear position of the carrier so that relative roller-carrier movement causes the arcuate surfaces of the feet 33, 34 to apply the proper progressive forces to the wires 21. In the illustrated construction, the stop portions 31, 32 are blocks anchored to the carrier 12 by machine screws 35, the block 32 being slotted to permit exact lateral positioning of the connector. Preferably, a leaf spring 36 is mounted on the carrier 12 to hold the connector 24 after it is manually placed against the stop portion blocks 31, 32.

To insure balanced, non-skewing coupling between the roller 13 and the carrier 12, that coupling is achieved by meshing a pair of pinion gears 41 mounted on the roller shaft 15 with a pair of gear racks 42 fixed on the carrier 12. Relative movement between the roller 13 and the carrier 12 is obtained through a simple hand crank 43 fixed to the roller shaft 15.

From a starting position, established preferably by set screws (not shown) in the pinion gears 41, linear movement of the carrier 12 causes the stop portion block 31 to press against the connector 24 so as to push it beneath the roller 13, thus reliably holding the cable-connector assembly in the desired relative position to the roller.

In the particular cable-connector illustrated, and as made plain in said prior application Ser. No. 771,109, the transition plates 23 in the connector are in two levels (see FIG. 7) so that the roller feet 33 acting on the lower level wires 21 must pass between the wires extending to the upper transition plate 23. The feet 33 are thus spaced, with one foot being provided for each wire (see FIG. 4), and these spaced feet 33 reliably interfit in proper positions to engage the proper wires because of the tightly maintained relationship between the carrier 12 and the roller 13. The foot 34 acting on the upper tier wires is preferably a single bar to simplify construction.

The illustrated apparatus 10 also includes a support post 48 so as to hold the cable 22 level during the terminating operation.

It can now be readily seen that the apparatus 10 has the rigidity, preciseness and simplicity to accurately perform its intended function even though very small cable and connector components are being acted upon. Once the apparatus 10 has been initially set up, no further elaborate set-up time or adjustment effort is required.

It will also be apparent to those skilled in the art that the apparatus 10 is quite simple to use requiring only that the cable 22 be stripped, formed with a sharp rib 49 that is fitted in a slot 50 in the connector 24 (see previously identified application Ser. No. 771,109) whereupon the cable-connector assembly is placed in the apparatus with the connector abutting the stop portion blocks 31, 32. The spring 36 holds the connector in proper position and the operator simply turns the crank 43 to accomplish the mechanical termination function with complete reliability.

The apparatus 10 is quite compact and portable and hence well suited for being brought right to the job site for making completed cable-connector assemblies at the point of application.

We claim

1. Apparatus for mechanically terminating a wire to a plate member having an open throated slot by applying force to the wire progressively from the open throat toward the slot, comprising, in combination, a frame, a carrier mounted on said frame for linear reciprocation, a roller journalled on said frame above said carrier, said carrier having stop portions for positively positioning a plate on said carrier, said roller having a radially projecting foot with an arcuate outer surface, means for coupling said roller and said carrier so as to maintain a predetermined angular position of the roller for every linear position of the carrier, and means for rotating said roller and reciprocating said carrier, said foot and said stop portions being positioned so that said outer surface applies progressive force to a wire over a slot in a plate when the plate is against said stop portions and the roller is rotated and the carrier is reciprocated.

2. The combination of claim 1 in which said means for coupling include a pair of gears on said roller meshed with a pair of racks on said carrier so as to provide balanced, non-skewing coupling between the roller and the carrier.

3. The combination of claim 1 including a plurality of feet on said roller for applying force to a plurality of closely spaced wires to corresponding slots in the plate upon rotation of said roller and reciprocation of said carrier.

4. The combination of claim 1 including means for resiliently holding a plate against said stop portions.

* * * * *